US010446351B2

(12) United States Patent
Mantoan et al.

(10) Patent No.: US 10,446,351 B2
(45) Date of Patent: Oct. 15, 2019

(54) ELECTRICAL CONTACT ASSEMBLY

(71) Applicant: Littelfuse, Inc., Chicago, IL (US)

(72) Inventors: Davide Mantoan, Leguago (IT); Paolo Ghirigato, Terrazzo (IT); Claudio Crovetti, Mantova (IT)

(73) Assignee: LITTELFUSE, INC., Chicago, IL (US)

( * ) Notice: Subject to any disclaimer, the term of this patent is extended or adjusted under 35 U.S.C. 154(b) by 0 days.

(21) Appl. No.: 15/614,781

(22) Filed: Jun. 6, 2017

(65) Prior Publication Data

US 2018/0350544 A1 Dec. 6, 2018

(51) Int. Cl.

| | |
|---|---|
| ***H01H 50/54*** | (2006.01) |
| ***H01H 1/26*** | (2006.01) |
| ***H01H 51/28*** | (2006.01) |
| ***H01H 11/04*** | (2006.01) |
| ***H01H 11/06*** | (2006.01) |

(52) U.S. Cl.

CPC ..... *H01H 50/54* (2013.01); *H01H 1/26* (2013.01); *H01H 11/042* (2013.01); *H01H 11/06* (2013.01); *H01H 51/281* (2013.01); *H01H 51/287* (2013.01); *H01H 2011/067* (2013.01)

(58) Field of Classification Search

CPC ..... H01R 11/09; H01R 12/515; H01R 12/57; H01R 12/58; H01R 2101/00; H01R 25/16; H01R 4/22; H01R 4/2483; H01R 4/2487; H01R 4/34; H01R 4/56; H01R 4/64; H01R 9/24; H01R 9/2458; H01H 50/54; H01H 11/06; H01H 11/042; H01H 51/287; H01H 1/26; H01H 51/281; H01H 2011/067

USPC ..... 200/243, 275, 262, 266; 439/251, 801, 439/29, 475, 583, 758

See application file for complete search history.

(56) References Cited

U.S. PATENT DOCUMENTS 2,419,469 A 4/1947 Spiro
3,918,625 A * 11/1975 Nippert ..... H01L 21/4878 174/548

(Continued)

FOREIGN PATENT DOCUMENTS

| | | |
|---|---|---|
| CN | 106463278 A | 2/2017 |
| DE | 7206287 U | 10/1972 |
| DE | 9110356 U1 | 12/1992 |

(Continued)

OTHER PUBLICATIONS

European Search Report for the European Patent Application No. EP18176326, dated Nov. 7, 2018.

*Primary Examiner* — Ahmed M Saeed

(57) ABSTRACT

An electrical contact assembly including an elongate stud having a coupling end and an opposing butt end, the butt end having a recess formed therein, the recess having a head portion and a shank portion defining a shoulder at a juncture therebetween, the head portion bounded by a collar and having a diameter that is larger than a diameter of the shank portion, and a contact pad having a head and a shank, the head having a top surface and a bottom surface with a tapered sidewall extending therebetween, the shank extending from the bottom surface of the head and having a diameter that is smaller than a diameter of the bottom surface, wherein the contact pad is disposed within the recess with the bottom surface of the head disposed on the shoulder and with the collar extending over and engaging the angled sidewall of the head.

20 Claims, 6 Drawing Sheets

(56) References Cited

U.S. PATENT DOCUMENTS

| | | | | |
|---|---|---|---|---|
| 2005/0106952 | A1* | 5/2005 | Maxwell | H01R 11/285<br>439/761 |
| 2010/0159737 | A1* | 6/2010 | Elsaesser | H01R 4/2483<br>439/416 |

FOREIGN PATENT DOCUMENTS

| | | | |
|---|---|---|---|
| EP | 1995745 | A1 | 11/2008 |
| GB | 691183 | A | 8/1947 |
| JP | H01144530 | A | 6/1989 |
| JP | H11176269 | A | 7/1999 |

* cited by examiner

ELECTRICAL CONTACT ASSEMBLY

FIELD OF THE DISCLOSURE

This disclosure relates generally to the field of electrical contact devices, and relates more particularly to an electrical contact assembly for use in electrical relays and a method for making the same.

BACKGROUND OF THE DISCLOSURE

Electrical relays are commonly employed for controllably establishing electrical connections between sources of electrical power and electrical devices. A typical electrical relay may include a power input, a power output, and a control input. Electrical current may be applied to, or removed from, the control input to selectively establish an electrical connection between the power input and the power output.

The power input and power output of a typical electrical relay are commonly embodied by electrically conductive posts or "studs" that may be connected to a source of electrical power and to an electrical device, respectively. The control input may be a simple screw terminal or the like. When an appropriate actuation current is applied to the control input, an electrically conductive contactor may be moved (e.g., via electromagnetic force) into contact with butt ends of the power input and power output that are disposed within a housing. An electrical pathway is thereby established between the source of electrical power and the electrical device.

The conductive studs that are employed for the power inputs and power outputs of electrical relays are commonly formed of silver-treated copper and are provided with silver contact pads embedded in the butt ends thereof for providing a robust electrical connection with the contactor. Conventionally, the silver pads are fastened to the butt ends of the studs via processes that involve either soldering or screwing and pressing. Such processes include numerous manufacturing steps that can be time-consuming, costly, and that can result in damage to the studs.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An electrical contact assembly in accordance with an exemplary embodiment of the present disclosure may include an elongate stud having a coupling end and an opposing butt end, the butt end having a recess formed therein, the recess having a head portion and a shank portion defining a shoulder at a juncture therebetween, the head portion bounded by a collar and having a diameter that is larger than a diameter of the shank portion, and a contact pad having a head and a shank, the head having a top surface and a bottom surface with a tapered sidewall extending therebetween, the shank extending from the bottom surface of the head and having a diameter that is smaller than a diameter of the bottom surface, wherein the contact pad is disposed within the recess with the bottom surface of the head disposed on the shoulder and with the collar extending over and engaging the angled sidewall of the head to retain the contact pad within the recess.

A method of forming an electrical contact assembly in accordance with an exemplary embodiment of the present disclosure may include providing an elongate stud having a coupling end and an opposing butt end, the butt end having a recess formed therein, the recess having a head portion and a shank portion defining a shoulder at a juncture therebetween, the head portion bounded by a collar and having a diameter that is larger than a diameter of the shank portion, providing a contact pad having a head and a shank, the head having a top surface and a bottom surface with a tapered sidewall extending therebetween, the shank extending from the bottom surface of the head and having a diameter that is smaller than a diameter of the bottom surface, disposing the contact pad within the recess with the bottom surface of the head disposed on the shoulder, and deforming the collar so that the collar extends over and engages the angled sidewall of the head to retain the contact pad within the recess.

An electrical contact assembly and a method of manufacturing the same in accordance with the present disclosure will now be described more fully hereinafter with reference to the accompanying drawings, in which preferred embodiments of the electrical contact assembly and the associated method are presented. The electrical contact assembly and the associated method may, however, be embodied in many different forms and should not be construed as being limited to the embodiments set forth herein. Rather, these embodiments are provided so that this disclosure will convey certain exemplary aspects of the electrical contact assembly and the associated method to those skilled in the art.

Figure 1:
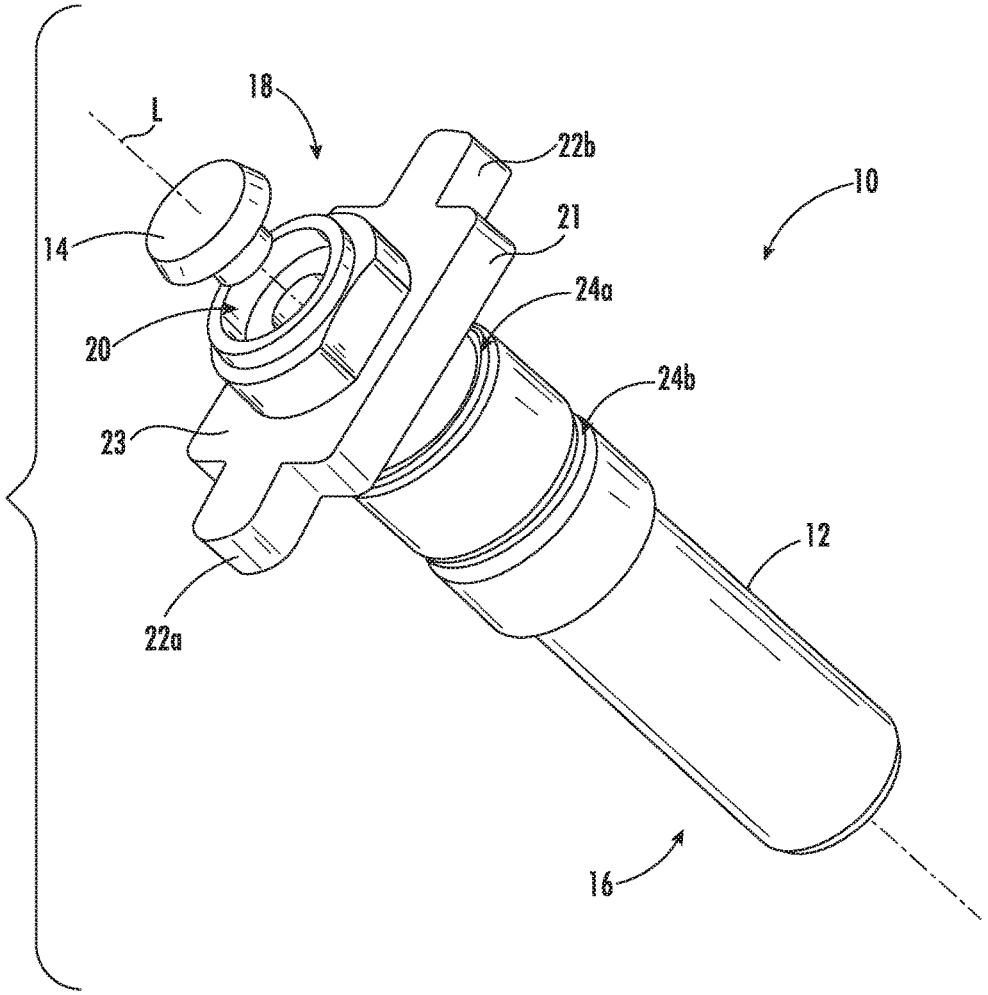
FIG. 1 is a perspective view illustrating an exemplary embodiment of an electrical contact assembly in an unassembled state in accordance with the present disclosure.

Referring to FIG. 1, an electrical contact assembly 10 (hereinafter "the assembly 10") in accordance with the present disclosure is shown. The assembly 10 may be suitable for implementation as a power input or a power output in an electrical relay, such as an automotive electrical relay. It will be understood, however, that the assembly 10 is not limited to such application, and that the assembly 10 may be employed in various other electrical devices and applications without limitation.

The assembly 10, which is shown in FIG. 1 in a "non-assembled" state (as described in greater detail below) may include an electrically conductive stud 12 and an electrically conductive contact pad 14. In some examples, the stud 12 may be formed of copper and/or other metals having good electrical conductivity, and may be treated or coated with silver and/or other metals having excellent electrical conductivity (e.g., a metal that has electrical conductivity superior to that of the copper or other metal from which the stud 12 is formed). The contact pad 14 may be formed of silver and/or other metals having excellent electrical conductivity (e.g., a metal that has electrical conductivity superior to that of the copper or other metal from which the stud 12 is formed). The present disclosure is not limited in this regard.

The stud 12 may be an elongate, generally cylindrical member having a coupling end 16 and an opposing, butt end 18. The coupling end 16 may be adapted for coupling to a lead of an electrical power source or electrical device. In some examples, the coupling end 16 may be threaded for accommodating a nut or other removable fastener as will be appreciated by those of ordinary skill in the art. The butt end 18 of the stud 12, which may be adapted to be disposed within an electrically insulating housing of an electrical relay (not shown), may include a recess 20 for receiving and retaining the contact pad 14 as further described below. The butt end 18 may further include a base portion 21 extending radially-outwardly therefrom and defining a planar support surface 23 adjacent the recess 20. The support surface 23 may be oriented substantially perpendicular to a longitudinal axis L of the stud 12. The stud 12 may further include flanges 22*a*, 22*b*, grooves 24*a*, 24*b*, and/or other structural elements adapted for securely anchoring the assembly 10 within a housing of an electrical relay or other device. It will be appreciated that the flanges 22*a*, 22*b* and grooves 24*a*, 24*b* shown in FIG. 1 are merely exemplary and may be varied or omitted without departing from the scope of the present disclosure.

Figure 2:
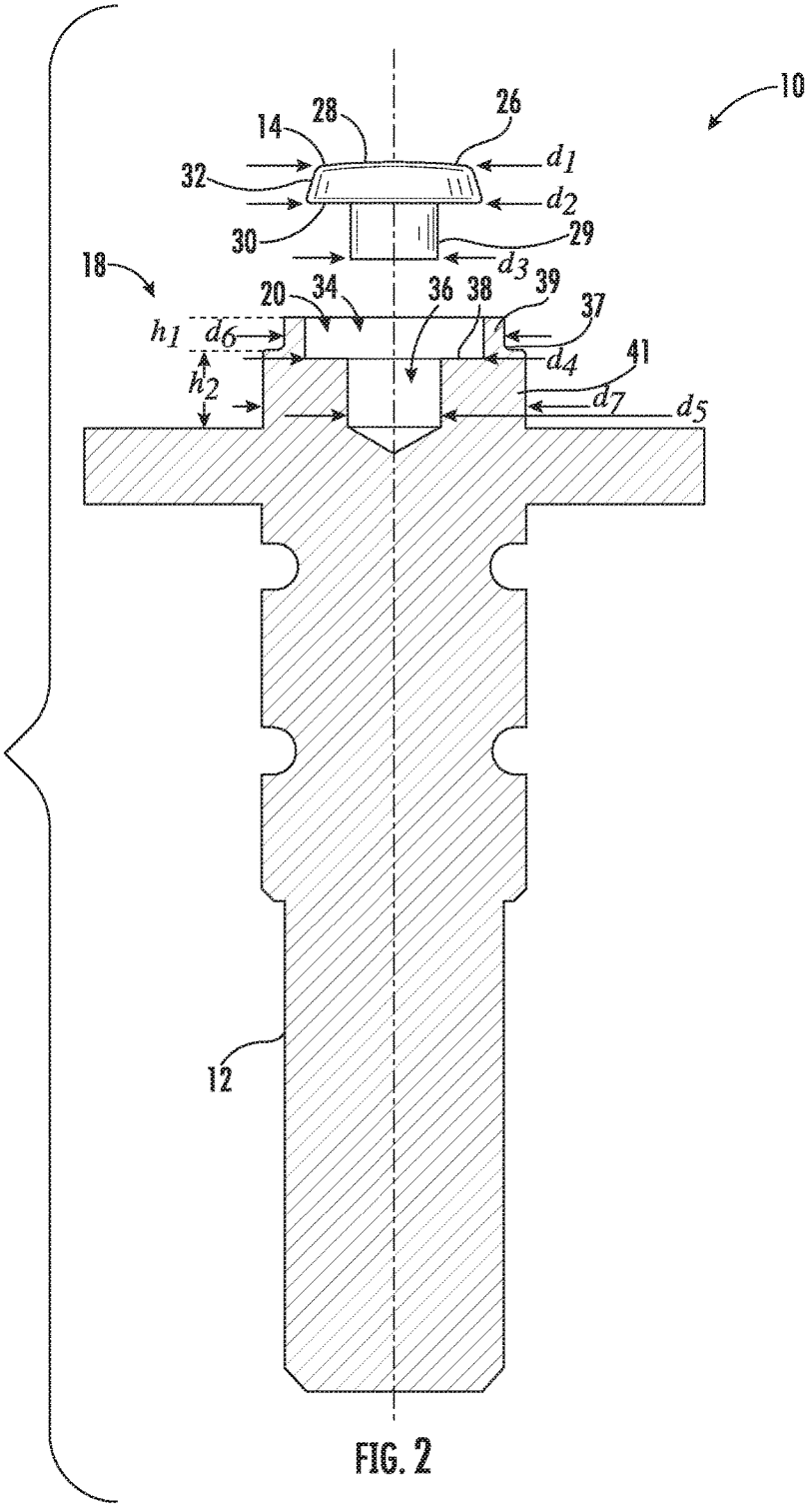
FIG. 2 is a cross sectional side view illustrating the unassembled electrical contact assembly shown in FIG. 1.

Referring to the cross-sectional view of the assembly 10 shown in FIG. 2 (again in an "unassembled state"), the contact pad 14 may include a generally disc-shaped head 26 having a first, top surface 28 with a diameter $d_1$, a second, bottom surface 30 with a diameter $d_2$ that is greater than $d_1$, and a tapered sidewall 32 extending between the top surface 28 and the bottom surface 30. The top surface 28 may be convex or "domed" for facilitating a good electrical connection with an electrical contactor or other element that may be disposed in engagement with the contact pad 14. The contact pad 14 may further include a cylindrical shank 29 extending from the bottom surface 30 of the head 26 and having a diameter $d_3$ that is smaller than $d_2$.

Figure 3:
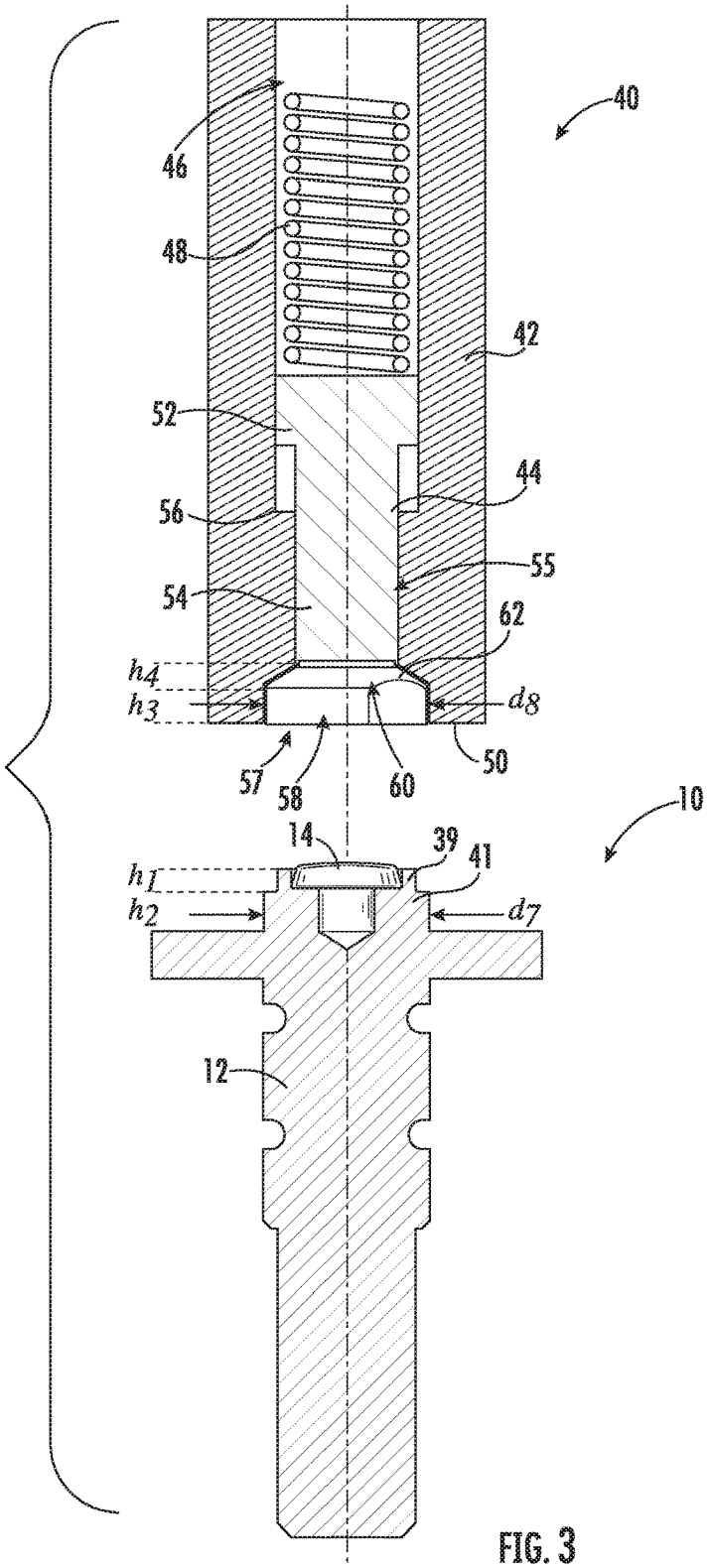
FIG. 3 is a cross sectional side view illustrating the electrical contact assembly shown in FIG. 1 and press fitting tool in accordance with an embodiment of the present disclosure.

The recess 20 in the butt end 18 of the stud 12 may include a generally disc-shaped head portion 34 having a diameter $d_4$ and a cylindrical shank portion 36 extending from the bottom of the head portion 34 and having a diameter $d_5$ that is smaller than $d_4$. The juncture of the head portion 34 and the shank portion 36 may therefore define an annular shoulder 38. The aggregate size and shape of the recess 20 may be similar to the size and shape of the contact pad 14, such that the contact pad 14 may be disposed within the recess 20 with the head 26 seated upon the shoulder 38, and with the head 26 and the shank 29 being disposed in a radially close clearance relationship with the surrounding portions of the butt end 18 (as shown in FIG. 3). In a non-limiting example, the diameter $d_5$ of the shank portion 36 of the recess 20 may be about 1 millimeter larger than the diameter $d_3$ of the shank 29 of the contact pad 14, and the diameter $d_4$ of the head portion 34 of the recess 20 may be about 0.1 millimeter larger than the diameter $d_2$ of the bottom surface 30 of the head 26 of the contact pad 14.

An annular shoulder 37 may be formed in the butt end 18 of the stud 12 to define a thin annular collar 39 that surrounds the head portion 34 of the recess 20. The collar 39 may have an outer diameter $d_6$ that is smaller than an outer diameter $d_7$ of a relatively thicker annular sidewall 41 defined by an adjoining portion the butt end 18 that surrounds the shank portion 36 of the recess 20 and that extends between the collar 39 and the support surface 23 of the base portion 21 of the stud 12. The collar 39 may have a height $h_1$ and the sidewall 41 may have a height $h_2$.

FIG. 3 illustrates a cross sectional view of an exemplary embodiment of a specialized press-fitting tool 40 for securely fastening the contact pad 14 to the butt end 18 of the stud 12. The press-fitting tool 40 may include a cylinder 42, a punch 44 disposed within a hollow interior 46 of the cylinder 42 and axially movable therein, and a spring 48 disposed within the hollow interior 46 in engagement with the punch 44 for biasing the punch 44 toward a tip 50 of the cylinder 42. The punch 44 may include a cylindrical head 52 and a cylindrical shank 54, the head 52 having a larger diameter than the shank 54. The hollow interior 46 may include a narrowed portion 55 adjacent the tip 50, thus defining an annular shoulder 56 below the head 52, the shoulder 56 having an interior diameter larger than that of the shank 54 but smaller than that of the head 52. The shoulder 56 may thus provide a lower stop that limits downward axial movement of the head 52 for preventing the punch 44 from falling out of the tip 50 of the cylinder 42.

A recess 57 may be formed in the tip 50 of the cylinder 42 and may be contiguous with the narrowed portion 55 of the hollow interior 46 of the cylinder 42. The recess 57 may include a cylindrical bottom portion 58 and a frusto-conical top portion 60. The top portion 60 may be defined by an annular, angled sidewall 62 extending between the narrowed portion 55 of the hollow interior 46 and the bottom portion 58 of the recess 57. In a non-limiting example, the angled sidewall 62 may be oriented at an angle in a range of 30 degrees to 60 degrees relative to a longitudinal axis of the press-fitting tool 40. The bottom portion 58 of the recess 57 may have a diameter $d_8$ that is slightly larger (e.g., 1 millimeter larger) than the diameter $d_7$ of the sidewall 41 of the butt end 18 of the stud 12, and may have a height $h_3$ that is substantially equal to the height $h_2$ of the sidewall 41. The top portion 60 of the recess 57 may have a height $h_4$ that is substantially equal to the height $h_1$ of the collar 39 of the stud 12.

Figure 4A:
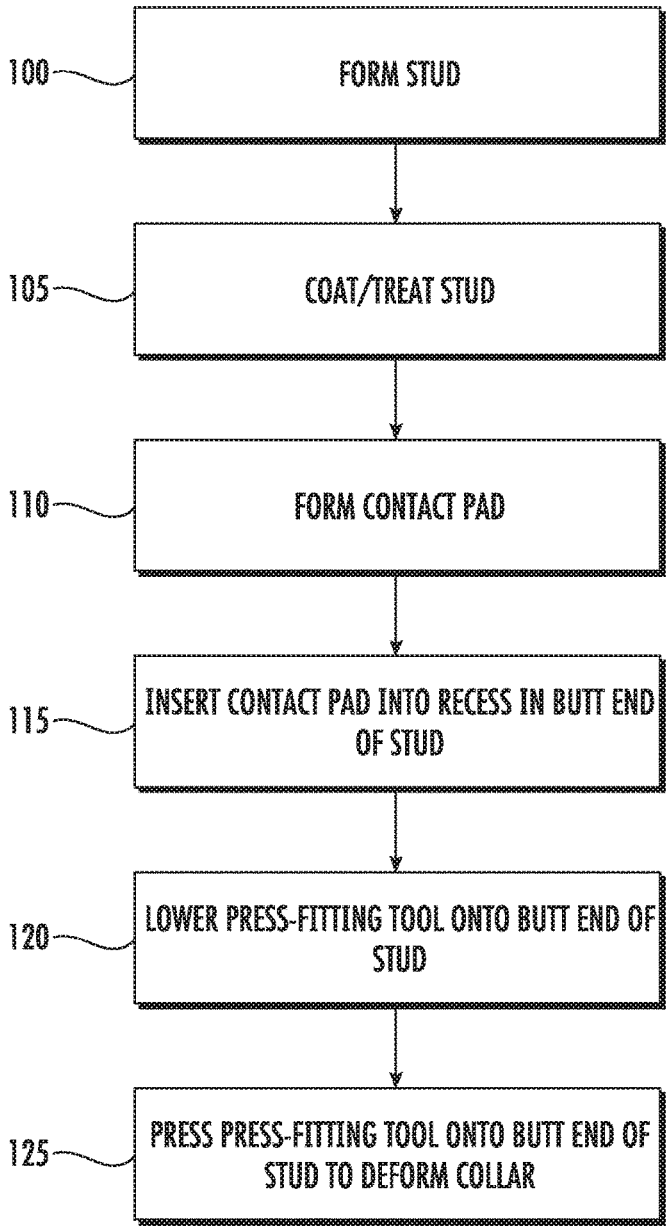
FIG. 4A is a flow diagram illustrating an exemplary embodiment of a method for manufacturing an electrical contact assembly in accordance with the present disclosure.

Referring to FIG. 4A, a flow diagram illustrating an exemplary embodiment of a method of manufacturing the above-described assembly 10, including using the press-fitting tool 40 to securely fasten the contact pad 14 to the butt end 18 of the stud 12, is presented. The method will now be described in detail with reference to above-described FIGS. 1-3 as well as additional cross sectional views of the assembly 10 and the press-fitting tool 40 illustrated in FIGS. 4B and 4C.

In step 100 of the exemplary method, the stud 12 may be formed from copper and/or other metals having good electrical conductivity. This may be accomplished via turning, rolling, and/or other conventional manufacturing methods that will be familiar to those of ordinary skill in the art, and may include forming the recess 20 in the butt end 18 of the stud 12. In step 105 of the method, the stud 12 may be treated or coated with silver and/or other metals having excellent electrical conductivity (e.g., a metal that is more expensive than, and that has electrical conductivity superior to that of, the copper or other metal from which the stud 12 is formed). In step 110 of the method, the contact pad 14 may be formed of silver and/or other metals having excellent electrical conductivity. This may be accomplished via turning, rolling, and/or other conventional manufacturing methods that will be familiar to those of ordinary skill in the art.

In step 115 of the exemplary method, the contact pad 14 may be inserted into the recess 20 in the butt end 18 of the stud 12, with the head 26 of the contact pad 14 seated upon the shoulder 38, and with the head 26 and the shank 29 disposed in a radially close clearance relationship with the surrounding portions of the butt end 18 (e.g., the collar 39 and the sidewall 41).

Figure 4B:
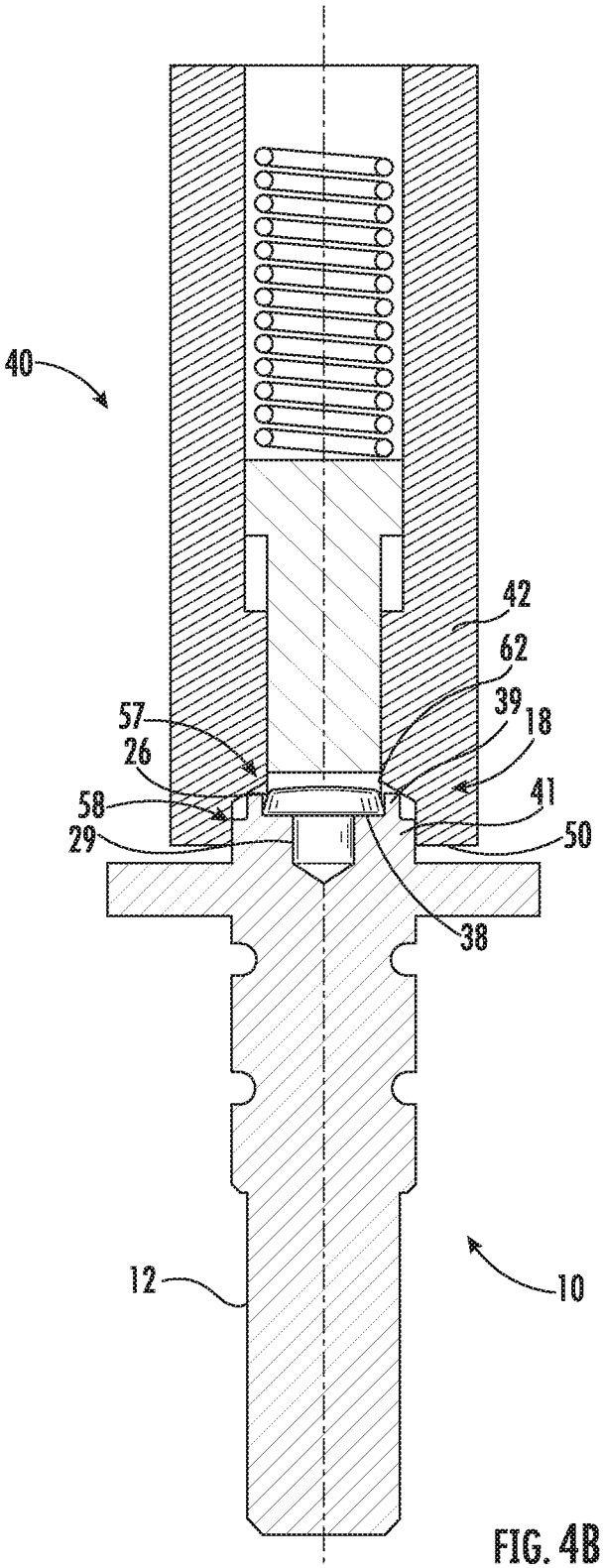
FIGS. 4B and 4C are a series of cross sectional side views illustrating various steps of the method of FIG. 4A.
Figure 4C:
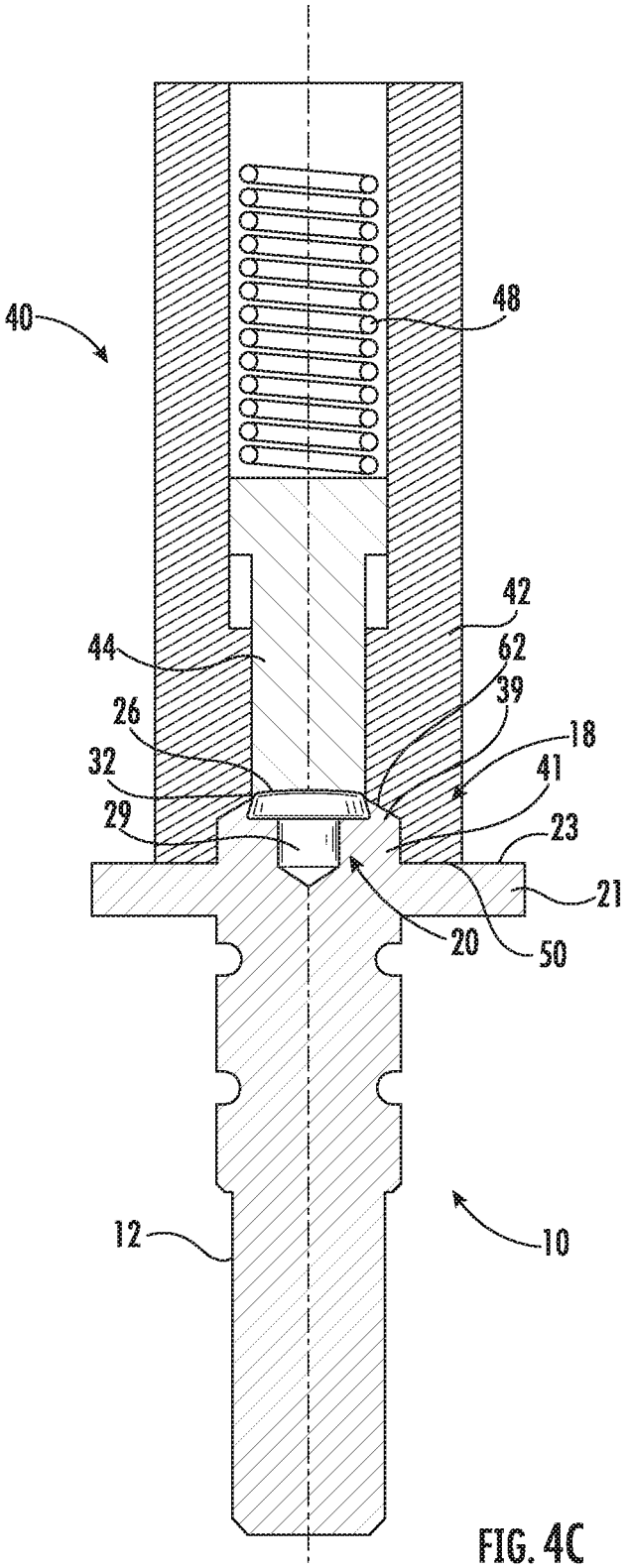

In step 120 of the exemplary method, the press-fitting tool 40 may be lowered onto the butt end 18 of the stud 12, with the sidewall 41 of the butt end 18 being disposed within the bottom portion 58 of the recess 57 in the tip 50 of the cylinder 42, and with the angled sidewall 62 engaging the collar 39 of the butt end 18 as shown in FIG. 4B. In step 125 of the method, the press-fitting tool 40 may be lowered further onto the butt end 18 of the stud 12 until the tip 50 is brought into contact with the support surface 23 of the base portion 21 of the stud 12 as shown in FIG. 4C. As the press-fitting tool 40 is lowered thusly, the punch 44, being biased by the spring 48, may hold the contact pad 14 in firm engagement with the stud 12, and the angled sidewall 62 may exert a radially inward and downward directed force on the collar 39 that is sufficient to deform the collar 39. In particular, the collar 39 may be deformed radially inwardly at an angle, with the collar 39 being disposed over, and in firm, conforming engagement with, the tapered sidewall 32 of the head 26 of the contact pad 14. The contact pad 14 may thus be secured within the recess 20 by the collar 39 in firm engagement and in good electrical contact with the stud 12.

It will be appreciated that the above-described assembly 10 and associated method, including fastening of the contact pad 14 to the stud 12, may be achieved without requiring any soldering, formation of threads, and/or screwing as in traditional methods for manufacturing similar electrical contact assemblies. The assembly 10 of the present disclosure may therefore be provided at a lower cost and may be manufactured more quickly than similar electrical contact assemblies manufactured using traditional methods.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. An electrical contact assembly comprising:

an elongate stud having a coupling end and an opposing butt end, the butt end having a recess formed therein, the recess having a head portion and a shank portion defining a shoulder at a juncture therebetween, the head portion bounded by a collar and having a diameter that is larger than a diameter of the shank portion; and a contact pad having a head and a shank, the head having a top surface and a bottom surface with a tapered sidewall extending therebetween, the shank extending from the bottom surface of the head and having a diameter that is smaller than a diameter of the bottom surface;

wherein the contact pad is disposed within the recess such that an entirety of the contact pad is disposed within the elongate stud with no portion of the contact pad extending outside of the elongate stud, and wherein the bottom surface of the head is disposed on the shoulder with the collar extending over and engaging the tapered sidewall of the head to retain the contact pad within the recess.

2. The electrical contact assembly of claim 1, wherein the top surface of the head has a diameter that is smaller than the bottom surface of the head.

3. The electrical contact assembly of claim 1, wherein the top surface of the head protrudes from the recess.

4. The electrical contact assembly of claim 3, wherein the top surface of the head is domed.

5. The electrical contact assembly of claim 1, wherein the shank portion of the recess is bounded by a sidewall of the stud, the sidewall having a diameter that is larger than a diameter of the collar.

6. The electrical contact assembly of claim 1, wherein the stud is formed of a first metal and the contact pad is formed of a second metal that is different than the first metal, the second metal having an electrical conductivity that is greater than an electrical conductivity of the first metal.

7. The electrical contact assembly of claim 6, wherein the first metal is copper and the second metal is silver.

8. The electrical contact assembly of claim 6, wherein the stud is coated with a third metal that is different than the first metal, the third metal having an electrical conductivity that is greater than an electrical conductivity of the first metal.

9. The electrical contact assembly of claim 6, further comprising a base portion extending radially-outwardly from the butt end and defining a support surface adjacent the recess.

10. The electrical contact assembly of claim 9, wherein the support surface is planar and is oriented perpendicular to a longitudinal axis of the stud.

11. A method of forming an electrical contact assembly, the method comprising:

providing an elongate stud having a coupling end and an opposing butt end, the butt end having a recess formed therein, the recess having a head portion and a shank portion defining a shoulder at a juncture therebetween, the head portion bounded by a collar and having a diameter that is larger than a diameter of the shank portion;

providing a contact pad having a head and a shank, the head having a top surface and a bottom surface with a tapered sidewall extending therebetween, the shank extending from the bottom surface of the head and having a diameter that is smaller than a diameter of the bottom surface;

disposing the contact pad within the recess, entirely within the elongate stud such that an entirety of the contact pad is disposed within the elongate stud with no portion of the contact pad extending outside of the elongate stud, with the bottom surface of the head disposed on the shoulder; and deforming the collar so that the collar extends over and engages the tapered sidewall of the head to retain the contact pad within the recess.

12. The method of claim 11, further comprising forming the stud from a first metal and forming the contact pad from a second metal that is different than the first metal, the second metal having an electrical conductivity that is greater than an electrical conductivity of the first metal.

13. The method of claim 12, wherein the first metal is copper and the second metal is silver.

14. The method of claim 12, further comprising coating the stud with a third metal that is different than the first metal, the third metal having an electrical conductivity that is greater than an electrical conductivity of the first metal.

15. The method of claim 11, wherein the stud includes a base portion extending radially-outwardly from the butt end and defining a support surface adjacent the recess, the support surface defining a plane oriented perpendicular to a longitudinal axis of the stud, wherein deforming the collar comprises placing a press-fitting tool over the butt end of the stud, the press-fitting tool including an elongate cylinder having a recess formed in a tip thereof, the tip being brought into engagement with the support surface, a portion of the recess in the tip being defined by an angled sidewall within the tip, the angled sidewall within the tip engaging and forcibly deforming the collar of the stud.

16. The method of claim 15, wherein the press-fitting tool includes an axially displaceable punch disposed adjacent the recess in the tip of the cylinder, the punch forcibly engaging the top surface of the head of the contact pad and holding the contact pad in engagement with the stud.

17. The method of claim 16, the press-fitting tool further including a spring biasing the punch toward the tip of the cylinder.

18. The method of claim 15, wherein the portion of the recess in the tip defined by the angled sidewall is frusto-conical in shape.

19. The method of claim 15, wherein the top surface of the head protrudes from the recess after the collar has been deformed.

20. The method of claim 19, wherein the top surface of the head is domed.

* * * * *